United States Patent [19]

Vollers

[11] Patent Number: 4,509,784

[45] Date of Patent: Apr. 9, 1985

[54] SCREW CAP REMOVER

[76] Inventor: Gary L. Vollers, 11471 Tampa Ave. No. 149, Northridge, Calif. 91326

[21] Appl. No.: 425,485

[22] Filed: Sep. 28, 1982

[51] Int. Cl.[3] ..... B25B 9/02

[52] U.S. Cl. ..... 294/99.1; 81/3.44

[58] Field of Search ..... 294/99 R, 1 R, 16; 81/3.4, 3.42, 3.44

[56] References Cited

U.S. PATENT DOCUMENTS

| | | | |
|---|---|---|---|
| 2,221,056 | 11/1940 | Mason | 81/3.4 |
| 2,985,046 | 5/1961 | Portheus | 81/3.44 |
| 2,990,213 | 6/1961 | Kolacinski | 81/3.44 |

*Primary Examiner*—James B. Marbert

*Attorney, Agent, or Firm*—William W. Haefliger

[57] ABSTRACT

A container cap removal tool includes a split ring defining a cap grip, and handles to actuate the split ring.

2 Claims, 4 Drawing Figures

SCREW CAP REMOVER

BACKGROUND OF THE INVENTION

This invention relates generally to removal of caps off container threaded necks; more particularly it concerns a simple tool in the form of a cap remover applicable to the cap skirt to grip same and easily twist the cap free of the neck.

Lightweight caps are currently made to tightly grip container necks below the threading, and frequently it is nearly impossible to manually remove, i.e. untwist such caps free of the necks. This gripping is effected to prevent or resist pilferage, or unwanted access to container contents, at point of sale. Accordingly, there is need for a simple means to allow unthreading of the "locked" cap off the container neck by the ultimate user or customer.

SUMMARY OF THE INVENTION

It is a major object of the invention to provide a container cap remover tool of simple and inexpensive design and manufacture, that will meet this need. Basically, the tool provided by the invention comprises:

(a) a split ring having a cap gripping inner surface about a central aperture adapted to receive a bottle cap, (b) and a pair of handles attached to said ring and extending in generally the same direction away from said ring, said handles being manually graspable and movable relatively toward one another to draw said ring surface into forcible gripping engagement with the cap, whereby the handles may then be rotated to rotate and loosen the cap.

Further, and as will appear, the cap remover may include a U-shaped extension to both handles integrally attached or molded to the split ring (or equivalent ring segments) to transfer torque from the handles to the ring; the ring may consist of an elastomer conformable to the undulating cap skirt during gripping; the ring and handles may define cusps that engage and act as stops to prevent overgripping of the cap; and the handles have flat outer sides to clearly display indicia, such as trademarks.

These and other objects and advantages of the invention, as well as the details of an illustrative embodiment, will be more fully understood from the following specification and drawings, in which:

DRAWING DESCRIPTION

DETAILED DESCRIPTION

Figure 4:
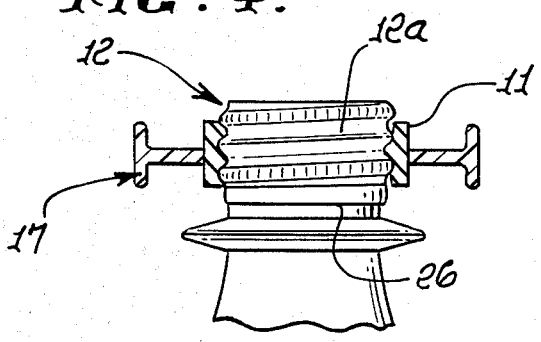
FIG. 4 is an elevation, partly in section, showing application of the cap remover to a container cap, for removing same.

The container screw-on cap remover 10 is shown to include a split ring 11 having a cap gripping inner surface 11*a*, which may be corrugated, or have spaced ridges to compressively grip the skirt 12*a* and cap 12. Surface 11*a* extends about a central aperture 13 adapted to receive the cap, as seen in FIG. 4. The cap may consist of thin aluminum sheet, for example.

The ring 11 may consist for example of elastomeric material such as thermoplastic rubber (butadiene being one element, for example). Examples are SOLPRENE, a product of Philips Chemical Company, and KRATON, a product of Shell Chemical Company. The ring shore hardness is preferably between 40 and 50.

The cap remover tool also includes a pair of handles 14 and 15 attached to the ring as via its periphery, the handles extending in generally the same direction away from the ring, and spaced apart 16 to provide stop shoulders 14*a* and 15*a*. A U-shaped extension 17 of the handles extends at least part way about the split ring to provide a hinge, and is circularly and integrally attached at 17*a* to its periphery; thus, the extension and ring may be molded at the same time, or substantially the same time. The handles and extension 17 typically consist of synthetic resin, examples being styrene and polycarbonate.

It will be noted that the handles and ring define two like cusps 20 that project toward one another proximate the split 21 defined by the ring. The cusps ensure optimal gripping of the cap skirt by the ring, and also provide auxiliary stop shoulders that engage when such optimal gripping is achieved, to prevent overgripping damage to the cap and tool. The handle ends furthest from the ring have convex curvature at 14*b* and 15*b* to match the outer convex curvature at 17*b* of the U-shaped extension 17, for ease of handling and use of the tool.

Figure 1:
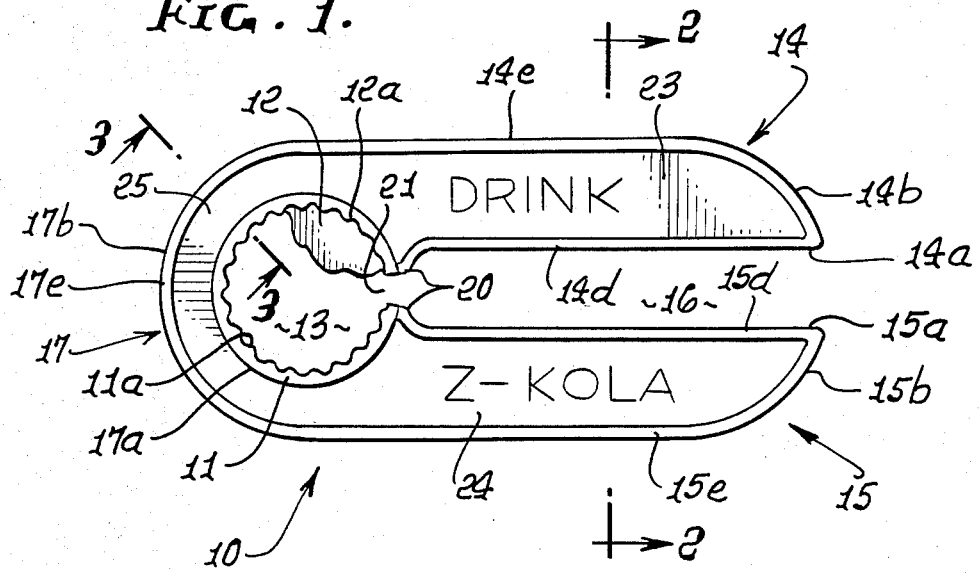
FIG. 1 is a side elevation.
Figure 3:
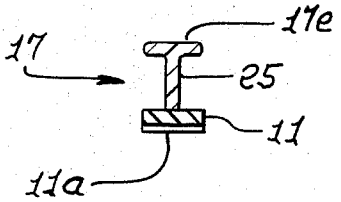
FIG. 3 is a section on lines 3—3 of FIG. 1.
Figure 2:
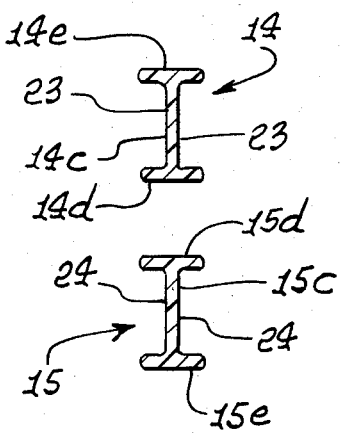
FIG. 2 is a section on lines 2—2 of FIG. 1.

Of particular importance is the provision of handle flat sides 23 and 24, as on opposite sides of the elongated handles (see FIG. 2), for use in displaying indicia, such as trademarks or other markings. Such flat sides may be formed by webs 14*c* and 15*c* between inner and outer peripheral flanges 14*d* and 14*e*, and 15*d* and 15*e*. Such outer flanges 14*e* and 15*e* provide flat outer surfaces for manual pressure reception and ease of handling of the tool. Thus, the handles have I shaped cross section in planes normal to the handle length. Further, the flanges 14*e* and 15*e* merge with the curved outer flange 17*e* of extension 17. Similarly, webs 23 and 24 merge with curved web 25 defined by extension 17 to define a plane normal to an axis defined by ring 11.

Note in FIG. 4 that the ring 11 conforms to the undulating outer surface of the cap skirt, which has the "threaded" shape of the bottle neck thread, during gripping of the cap. Note the cap lower portion 26 which tightly grasps the neck to prevent pilferage and frequently prevents manual removal of the cap from the neck, in the absence of the present tool.

Instead of a ring 11, equivalent grippers may be employed, and which are segmented but located in a ring shaped path, about opening 13.

I claim:

1. A container screw-on cap remover, comprising (a) a split ring having a cap gripping inner surface about a central aperture adapted to receive a bottle cap, (b) and a pair of handles attached to said ring and extending in generally the same direction away from said ring, said handles being manually graspable and movable relatively toward one another to draw said ring surface into forcible gripping engagement with the cap, whereby the handles may then be rotated to rotate and loosen the cap, (c) the split ring consisting of an elastomer, and including a U-shaped integral extension of the handles extending part way about said elastomer split ring to provide a hinge and transfer torque to the split ring, the handles and U-shaped extension comprising a one-piece unit consisting of molded synthetic resin, (d) said U-shaped extension of said handles being integrally attached to said split ring, to transfer handle torque to the ring, the handles and U-shaped extension defining a single web which in turn defines a plane normal to an axis of said ring, (e) the handles being elongated and the web having flat sides for displaying indicia, the handles each having an I-shaped cross section in planes normal to the handle length dimension, and substantially throughout handle length, (f) said split ring interior surface being corrugated, the handles and ring defining cusps that project relatively toward one another proximate the split defined by the ring, (g) the handles and U-shaped extension having outer flanges that merge and define similar convex curvatures at opposite ends of the remover.

2. The cap remover of claim 1 wherein said split ring has a shore hardness of about 40 to 50.

* * * * *